US006065171A

United States Patent [19]

Tubman et al.

[11] Patent Number: 6,065,171

[45] Date of Patent: May 23, 2000

[54] DETERGENT DISPENSING METHOD AND APPARATUS FOR A VERTICAL AXIS WASHER

[75] Inventors: Casey J. Tubman, St. Joseph; Dale E. Mueller, Benton Harbor; Theodore D. Ernst, St. Joseph; James W. Titus, Coloma, all of Mich.

[73] Assignee: Whirlpool Corporation, Benton Harbor, Mich.

[21] Appl. No.: 09/253,273

[22] Filed: Feb. 19, 1999

[51] Int. Cl.[7] ..... D06F 39/02

[52] U.S. Cl. ..... 8/158; 68/23.5; 68/196; 68/207

[58] Field of Search ..... 68/210, 17 R, 68/207, 196, 23.5; 134/93; 8/158, 159

[56] References Cited

U.S. PATENT DOCUMENTS

| | | | |
|---|---|---|---|
| 2,523,801 | 9/1950 | Woodson | 68/23.5 |
| 3,086,379 | 4/1963 | Plante | 68/17 R |
| 3,121,317 | 2/1964 | Toma | 68/23.5 |
| 3,347,250 | 10/1967 | Martiniak | 68/207 |
| 3,696,970 | 10/1972 | Bunnell et al. | 68/17 R |
| 3,742,736 | 7/1973 | Fish et al. | 68/23.5 |
| 3,867,821 | 2/1975 | Hurwitz | 68/23.4 |
| 3,942,341 | 3/1976 | Sang | 68/17 R |
| 4,203,307 | 5/1980 | Obata et al. | 68/17 R |
| 4,265,100 | 5/1981 | Kretchman et al. | 68/12 R |
| 4,658,605 | 4/1987 | Yanagihara | 68/207 |
| 4,700,554 | 10/1987 | Eichman et al. | 68/17 R |
| 4,987,627 | 1/1991 | Cur et al. | 8/158 |
| 5,092,141 | 3/1992 | Quinn | 68/17 R |
| 5,486,287 | 1/1996 | Murphy et al. | 210/164 |
| 5,582,039 | 12/1996 | Mueller et al. | 68/17 R |
| 5,934,109 | 8/1999 | Kiefer et al. | 68/17 R |
| 5,937,677 | 8/1999 | Lee | 68/207 |

FOREIGN PATENT DOCUMENTS

| | | | |
|---|---|---|---|
| 53-100670 | 9/1978 | Japan | 68/207 |
| 62-34599 | 2/1987 | Japan | 68/23.5 |
| 691478 | 5/1953 | United Kingdom | 68/23.5 |

*Primary Examiner*—Frankie L. Stinson
*Attorney, Agent, or Firm*—Joel M. Van Winkle; Thomas J. Roth; Robert O. Rice

[57] ABSTRACT

A detergent dispensing method and apparatus for an automatic vertical axis washer. The washer includes a tub ring having a louvered area creating a drop zone through which wash additives are directly dispensed into the wash tub. In addition, the washer further includes a tub ring splash shield and D-ring splash shield. The tub ring and D-ring splash shields, along with the tub ring with the louvered area, act to direct wash additives into the wash tub and to further prevent wash fluid from escaping from the wash cycle.

19 Claims, 5 Drawing Sheets

18
16
10
22
66
20
36
64
34
42
44
28
38
40
72
V
V
IV
IV
52
54
50
12
56
58,60,62
84
14
80
76
78

DETERGENT DISPENSING METHOD AND APPARATUS FOR A VERTICAL AXIS WASHER

BACKGROUND OF THE INVENTION

The present invention generally relates to an automatic vertical axis clothes washer. More particularly, the present invention is directed to a detergent dispensing method and apparatus for an automatic vertical axis clothes washer that utilizes a tub ring with a louvered area through which wash additives are directly dispensed into the wash tub.

An automatic clothes washer is generally known to have a dispenser for dispensing wash additives such as detergent or additives, namely fabric softener or bleach. The dispenser provides the user with an efficient way to add wash additives to the washer. Dispensers are generally attached to a washer housing top, and accessible beneath an openable lid. A variety of well known dispensers are in the art. For example, U.S. Pat. No. 5,582,039 discloses an automatic washer having a wash additive dispenser. More particularly, it is known to provide an automatic washer having a dispenser in which wash additives are flushed or siphoned by water into the washer thereby effectively cleaning the dispenser surface of any remaining residual detergent or additives. U.S. Pat. No. 4,987,627 discloses a high performance washer having a dispenser through which wash additives are flushed by water into the wash tub. On the other hand, U.S. Pat. Nos. 4,700,554 and 4,265,100 disclose dispensers for granular and liquid wash additives in which granular wash additives are essentially flushed by water and liquid wash additives are siphoned by water into the wash tub. In addition, U.S. Pat. No. 4,203,307 discloses a dispenser through which wash additives are dispensed via a conduit into the wash tub. Lastly, U.S. Pat. No. 5,092,141 discloses a dispenser through which liquid wash additives are directly sprayed into the wash basket.

In addition, louvered areas are generally known in the art to screen or partially cover an opening. As applied to washers, a louvered area has been provided to cover an outlet through which suds are disposed during a washer spin cycle.

An existing problem in the art has been providing a way to dispense wash additives directly into the wash tub thereby enhancing the effective cleaning treatment of clothes. In addition, some vertical axis washers operating in non-traditional manners present a further need to prevent wash fluid, namely wash fluid spray, from escaping from the wash tub and inevitably the washer during a spin cycle. Moreover, there continues to exist a need to reduce operational noise levels from escaping to the surrounding environment during washer operation. A particular example of this noise is the high frequency splash associated with a concentrated or reduced water level wash cycle. The escape of operational noise to the surrounding environment can create a nuisance to the user. Thus, the effective cleaning treatment of clothes may be enhanced by dispensing wash additives directly into the wash tub. Moreover, it is desirable to prevent wash fluid spray and operational noise levels from escaping from the washer to the surrounding environment.

SUMMARY OF THE INVENTION

A detergent dispensing method and apparatus for an automatic vertical axis washer is provided that utilizes a tub ring with a louvered area through which wash additives are directly dispensed into the wash tub without a direct connection. The louvered area is attached to the tub ring and is generally positioned below a dispenser that is attached to a housing top of the washer. The louvered area includes a plurality of vanes creating a drop zone through which the wash additives are directly disposed into the wash tub, exterior of the clothes containing basket. The tub ring and louvered area can be formed of molded plastic.

In operation, the wash additives are first disposed into the dispenser. At some point in time during the wash cycle, the wash additives are released from the dispenser onto the louvered area and subsequently into the drop zone through which the wash additives are directly released into the wash tub. Moreover, the wash additives are released into the wash tub without a direct connection (such as a tube or other physical conduit) being made between the dispenser and the wash tub. Upon falling into the wash tub, the wash additives will energetically mix with water to form a wash fluid. Because of this mixing effect, the wash additives are more evenly dispersed throughout the wash fluid thereby effectively increasing the cleaning strength of the wash fluid. This added mixing step becomes even more important as applied to a concentrated or reduced water level wash cycle because there exists less water to aid in the mixing of the wash additives. Thus, the tub ring with a louvered area acts to increase the mixing efficiency of the wash additives to water in the wash fluid before the wash fluid contacts the clothes.

Moreover, the tub ring with louvered area acts to prevent wash fluid, namely wash fluid spray, from escaping from the wash tub, and inevitably the automatic vertical axis washer, during a spin cycle. Wash fluid spray may escape during a spin cycle. The washer includes an imperforate wash tub and a perforate wash basket disposed within the wash tub and rotatable about a vertical axis. During a spin step of the washer cycle, the force due to the rotation of the wash basket directs wash fluid against an inner wall of the wash tub. The wash fluid then can flow up the inner wall of the wash tub again due to the force exerted by the rotation of the wash basket. In doing so, the wash fluid, and including wash fluid spray, can escape from the wash tub from a gap between the wash tub and wash basket and inevitably from the washer, thus, creating a nuisance for the user.

However, the tub ring with louvered area are positioned to block the wash fluid spray before it escapes from the wash tub. The tub ring generally attaches to a top side of the wash tub and essentially extends to cover a gap between an inner wall of the wash tub and an outer wall of the wash basket. By closing this gap, the tub ring prevents wash fluid spray from escaping from the wash tub. In addition, the louvered area is angled in the direction of the rotation of the wash basket to provide an added barrier to the wash fluid spray.

Furthermore, the present invention further utilizes a tub ring splash shield and a D-ring splash shield along with the tub ring with louvered area to further direct the wash additives into the wash tub and to also prevent wash fluid, namely wash fluid spray, from escaping from the wash tub, and inevitably the automatic vertical axis washer, during a spin cycle.

The tub ring splash shield generally attaches to an outer edge of the tub ring and extends along at least a portion of the outer edge. The tub ring splash shield includes a flexible and rigid component but may alternatively be configured to have just a flexible component. The rigid component firmly attaches to the outer edge and can be made of nylon or other material with similar rigid properties. The flexible component extends upward from the rigid component and can be made of PVC or other material with similar flexible qualities. On the other hand, the D-ring splash shield generally attaches to a bottom surface of the housing top along at least a portion of the bottom surface. The D-ring splash shield is flexible and extends downward to the tub ring. It can be made of PVC or other material with similar flexible characteristics.

During operation, the wash tub and wash basket form a suspended mass that does not remain in a fixed position relative to the washer cabinet or housing. This is due to the fact that both are suspended from the housing in order to minimize operational forces exerted on the housing thereby allowing the washer to remain in a stationary position during operation. Accordingly, the gap between the suspended wash tub and the stationary cabinet may increase such that the tub ring with louvered area may not extend beneath the dispensers. Under this dynamic condition (when the wash basket and wash tub move in suspension), the tub ring splash shield and D-ring splash shield further act to direct wash additives into the wash tub and also to prevent wash fluid spray, that escapes from the tub ring, from escaping from the wash tub and inevitably from the washer. The tub ring splash shield extends upwardly from the tub ring to provide a barrier between the wash tub and an outer area of the housing. Alternatively, the D-ring splash extends downwardly from the housing top to provide a barrier between the wash tub and an inner area of the housing. As wash additives are released from the dispenser under dynamic conditions, the tub ring with louvered area may not necessarily be positioned to direct the entire charge of wash additives into the wash tub. In this case, the tub ring splash shield and D-ring splash shield provide an added funnel through which the wash additives are directed into the wash tub. Likewise, as wash fluid spray escapes from the gap between the wash tub and wash basket under these dynamic conditions, the tub ring with louvered area may not be positioned to block the entire gap. The tub ring splash shield and D-ring splash shield provide a further barrier to the wash fluid spray so as to prevent the wash fluid spray from escaping from the wash tub. Moreover, in this position, the D-ring splash shield also can act to prevent operational noise levels from escaping from the washer during operation.

It would be an improvement in the art, therefore, if a low cost and simple tub ring with louvered area, tub ring splash shield, and D-ring splash shield were provided in an automatic vertical axis washer to dispense wash additives directly into the wash tub, to prevent wash fluid spray from escaping from the wash tub, and to prevent operational noise from escaping from the washer during operation.

In an embodiment, a detergent dispensing method and apparatus for a vertical axis washer is provided wherein the washer has a housing enclosing a wash tub, a wash basket, and a tub ring; the housing includes a housing top with a dispenser to dispense wash additives into the washer; the wash basket is rotatable about a vertical axis and disposed within the wash tub; the tub ring secures to the wash tub defining an opening to provide access to the wash basket; and the tub ring includes a louvered area creating a drop zone through which wash additives are directly dispensed into the wash tub. Upon falling into the wash tub, the wash additives energetically mix with water to form a wash fluid. The wash fluid then passes into the wash basket to provide an effective cleaning treatment of clothes.

In a related embodiment, the louvered area is attached to the tub ring and positioned below a dispenser to guide wash additives directly into the wash tub.

In another related embodiment, the louvered area includes a plurality of vanes extending downward defining the drop zone through which wash additives fall directly into the wash tub.

In still another related embodiment, the plurality of vanes are angled in a rotational direction of the wash basket during a spin cycle so as to prevent wash fluid from escaping from the automatic vertical axis washer during the spin cycle.

In an embodiment, the tub ring also includes a tub ring splash shield attached along at least a portion of an outer edge of the tub ring and extending upward so as to prevent wash fluid from escaping from the automatic vertical axis washer during the spin cycle.

In an embodiment, the housing top also includes a D-ring splash shield attached along at least a portion of a bottom surface of the housing top and extending downward so as to prevent wash fluid and operational noise from escaping from the automatic vertical axis washer.

Additional features and advantages of the present invention are described in, and will be apparent from, the detailed description of the presently preferred embodiments.

DETAILED DESCRIPTION OF THE PRESENTLY PREFERRED EMBODIMENTS

Figure 1:
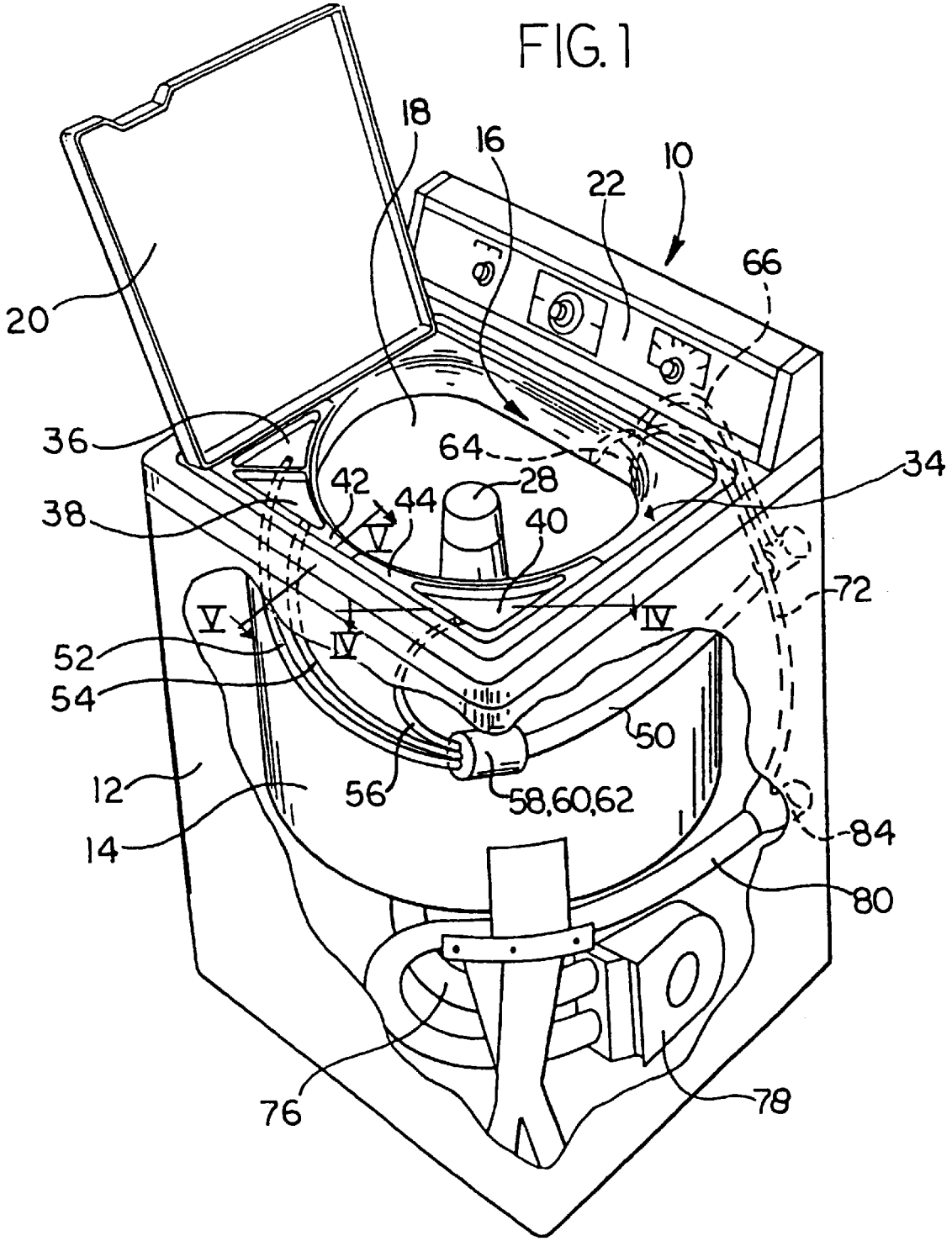
FIG. 1 illustrates a perspective view of a washer appliance embodying features of the present invention, having a portion cut away to illustrate details of internal components.

FIG. 1 generally illustrates a washer 10 embodying features of the present invention. The washer 10 includes a housing 12, a wash tub 14, a tub ring 16 defining an opening 18, a hinged lid 20 for covering the opening 18, and controls 22.

Figure 2:
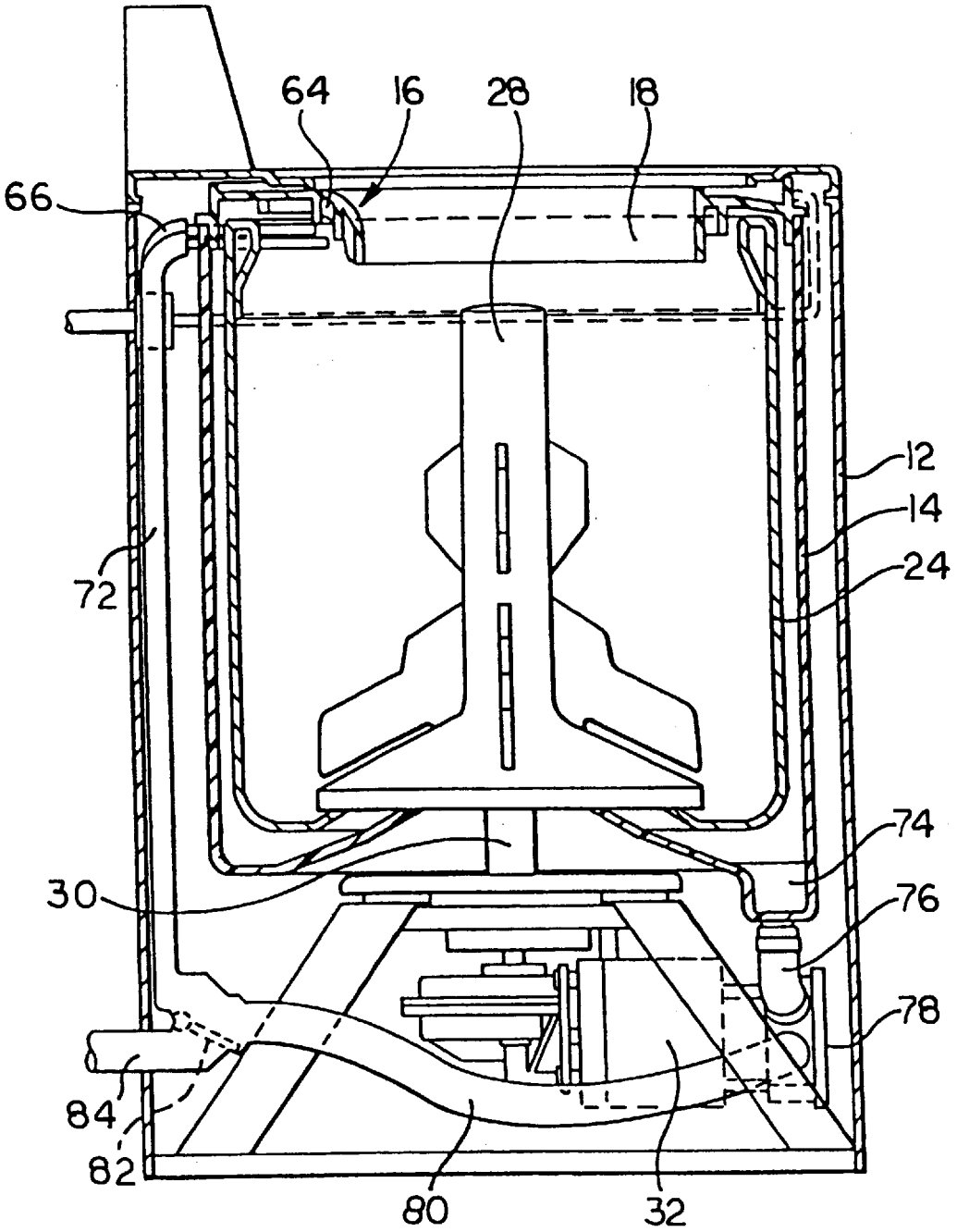
FIG. 2 illustrates a side, sectional view of the washer of FIG. 1.

Turning to FIG. 2, the washer 10 further includes a wash basket 24 disposed within the wash tub 14 and rotatable on a vertical axis. The wash basket 24 has an upwardly facing open end accessible through the opening 18. The wash tub 14 generally has a solid, cylindrical wall to contain water. The wash basket 24 is similar in shape, however, is slightly smaller in diameter than the wash tub 14 so that the wash basket 24 fits rotatably within the wash tub 14. The wash basket 24 has perforations or holes so that water can flow therethrough. The wash tub and wash basket are suspended relative to the housing 12 (not shown). A paddled agitator 28 extends vertically upward from the bottom of the wash tub 14 and resides within the wash basket 24. The wash basket 24 is rotatably movable on a shaft 30 which is rotatably sealed relative to the fixed wash tub 14. The shaft is driven by an electric motor 32.

In the embodiment illustrated, the washer 10 further includes a housing top 34. The housing top 34 can include a plurality of wash additive dispensers 36, 38, and 40. As seen in FIG. 1, these dispensers are accessible when the hinged lid 20 is in an open position. The dispensers 36 and 38 can be used for dispensing additives such as bleach or fabric softeners and the dispenser 40 can be used to dispense detergent into the wash load at an appropriate time in the automatic wash cycle. The dispensers 36 and 38 can be of known type to receive and dispense liquid additives into the wash tub 14. The dispenser 40 can be of the type for dispensing a granular or liquid wash additive, such as the dispenser disclosed in U.S. Pat. No. 4,700,554. Preferably, the upper portions of the dispensers 36 and 38 seen in FIG. 1 are formed by an upper panel 42 and the upper portion of the dispenser 40 is similarly formed by a panel 44.

Furthermore, as illustrated in FIGS. 1 and 2, the washer includes a first fresh water conduit 50 which is divided into sub-conduits 52, 54, and 56. Sub-conduits 52 and 54 supply a flow of water to dispensers 36 and 38. Similarly, the sub-conduit 56 supplies water to the dispenser 40. Water flow through the sub-conduits 52, 54, and 56 can be controlled through a conventional means such as respective solenoid operated valves 58, 60, and 62.

Additionally, in the embodiment illustrated in FIGS. 1 and 2, the washer 10 can include a nozzle 64 for supplying fresh water or recirculated water to the wash tub 14. The nozzle 64 receives a second fresh water conduit 66 which supplies fresh water to the nozzle 64. The nozzle 64 also receives a recirculation conduit 72 which supplies recirculated water. The water flowing from the conduits 66 and 72 is directed inwardly under the tub ring 16, being deflected downwardly and diffused along the curved contour of the opening 18 into the wash basket 24.

As illustrated in FIG. 2, the wash tub 14 has a lower drain portion 74 which can drain water through a drain conduit 76 to a recirculation pump 78. During initial filling and final rinse cycles, fresh water is provided through the nozzle 64. At various other times during the wash cycle, wash water is recirculated from the tub 14 to the nozzle 64. As shown in FIGS. 1 and 2, wash water exits the recirculation pump 78 through a tube 80. A valve 82 can selectively direct the flow to either a drain exit tube 84 or to the recirculation conduit 72.

Figure 3:
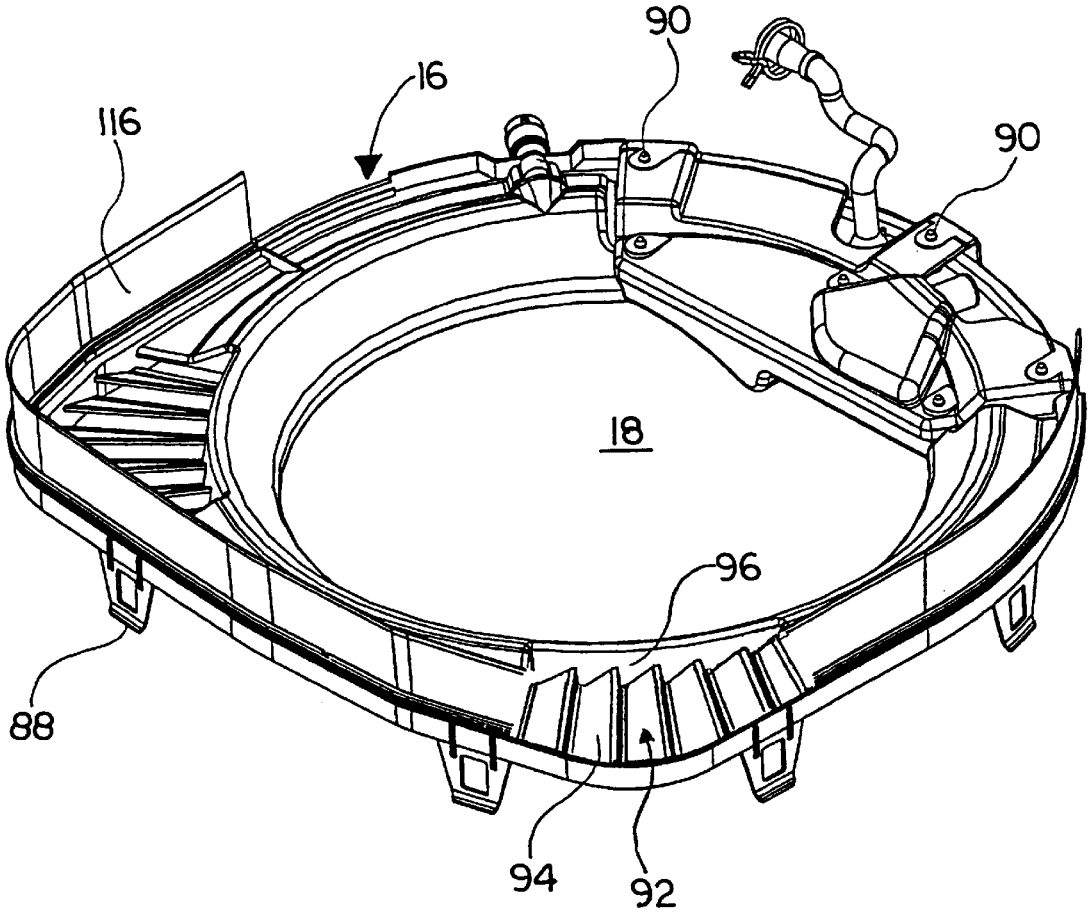
FIG. 3 illustrates a perspective view of the tub ring with a louvered area according to an embodiment of the present invention.

FIG. 3 illustrates the tub ring 16. The tub ring 16 is generally annular, having at least a partially rounded interior area defining the opening 18 to the wash basket 24 through which clothes are placed in and removed from the washer 10. The tub ring 16 generally forms an open surface of the washer 10 which is generally covered by the hinged lid 20. The tub ring 16 has a plurality of downwardly extending mounting clips 88 which engage cooperative slots (not shown) in the wash tub 14. Also, a plurality of mounting holes 90 are provided in the tub ring 16 through which respective connectors, such as screws (not shown) can extend to also engage the wash tub 14. Once the tub ring 16 is attached to the wash tub 14, the tub ring 16 provides the opening 18 that is dimensioned smaller than the diameter of the wash basket 24, so that a portion of the tub ring 16 overhangs the perimeter of the basket 24. In this position, the tub ring 16 acts to prevent wash fluid spray from escaping from the wash tub 14 during a spin cycle and also prevents items from accidentally being dropped between the wash basket 24 and the wash tub 14.

Figure 4:
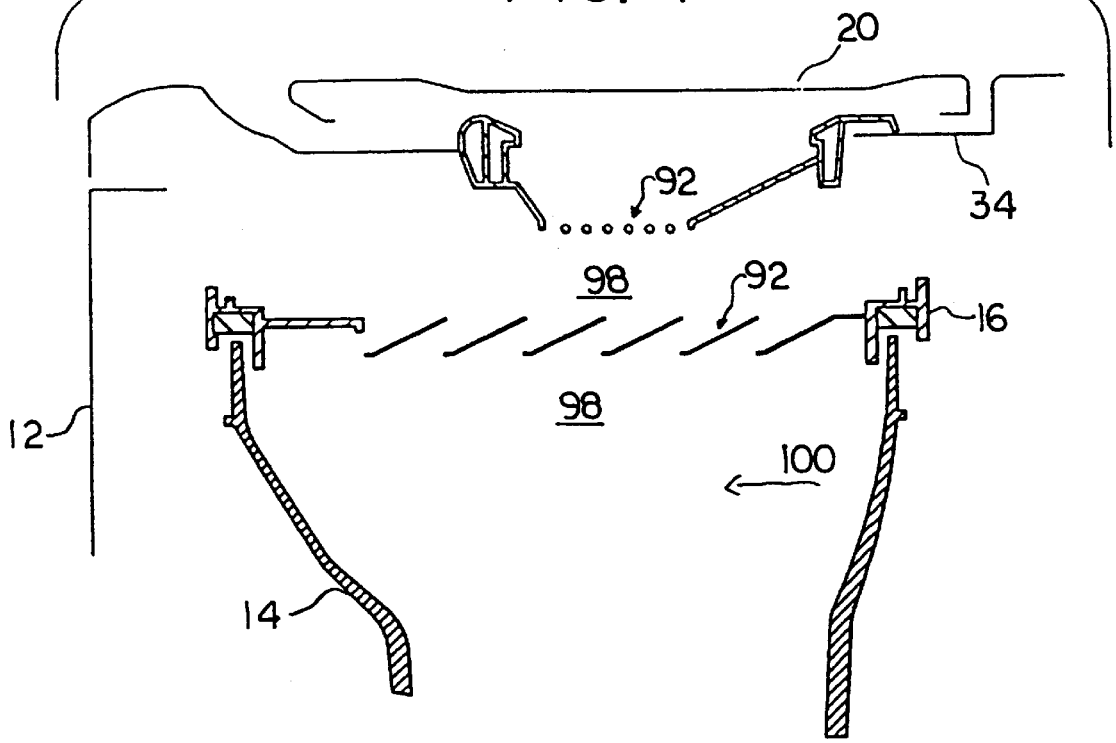
FIG. 4 illustrates a schematic side sectional view of the tub ring and other washer components generally along line IV—IV of FIG. 1.

As further illustrated in FIG. 3, the tub ring 16 further includes a louvered area 92. The louvered area 92 extends along at least a portion of the periphery of the tub ring 16. In particular, the louvered area 92 is generally positioned below the dispensers 36, 38, and 40 so that the wash additives fall directly onto the louvered area 92 once the wash additives are disposed into the dispensers 36, 38, and 40. The louvered area 92 can be formed of molded plastic. The louvered area 92 can include a plurality of vanes 94 attached to a flange 96 defining a periphery of the louvered area 92. As illustrated in FIG. 4, the plurality of vanes 94 create a drop zone 98 through which wash additives are directed into the wash tub 14. In addition, the vanes 94 are also angled in the rotational direction 100 of the wash basket 24 in order to prevent wash fluid spray from escaping from the wash tub during the spin cycle.

Figure 5:
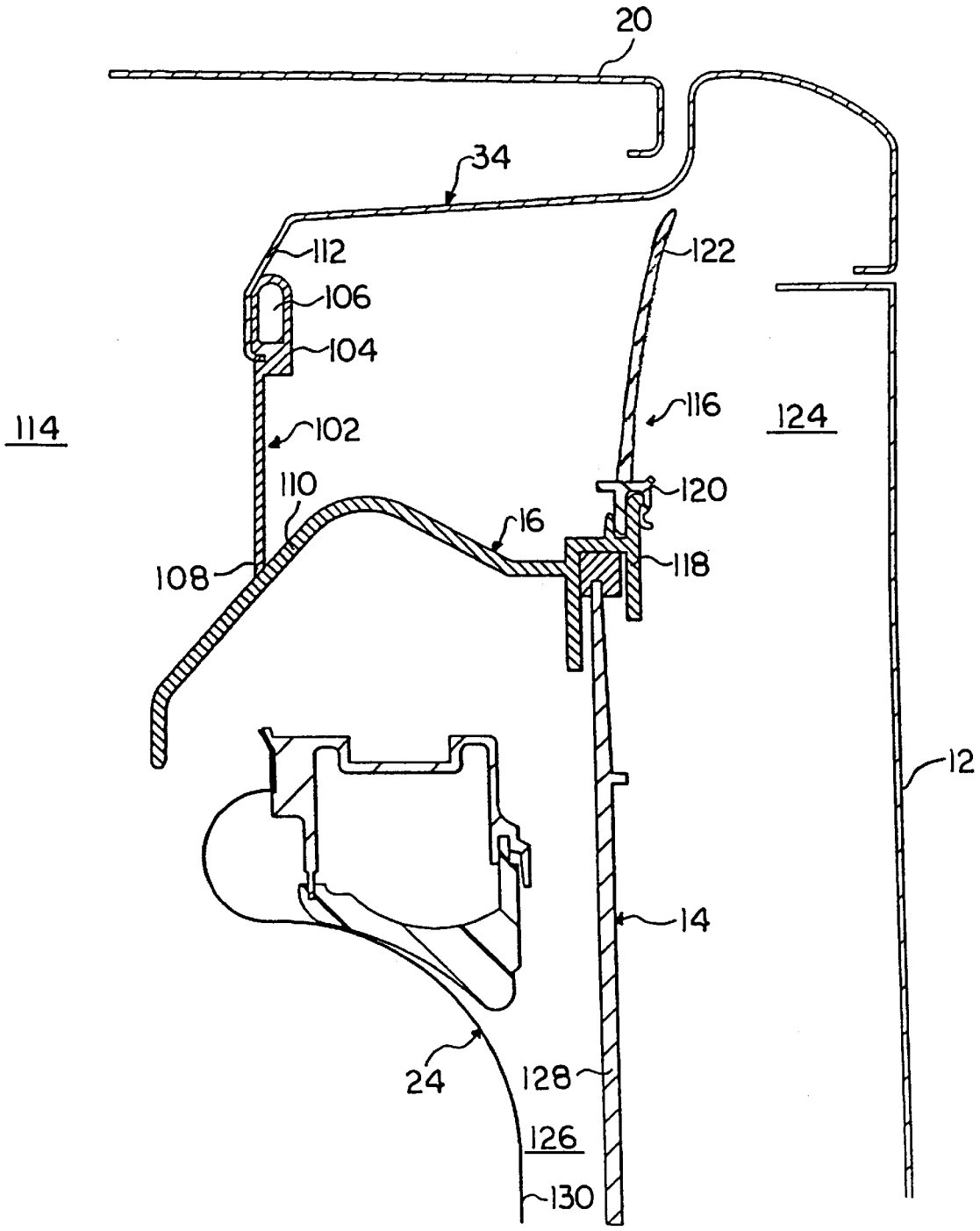
FIG. 5 illustrates a side sectional view of the tub ring and other washer components, including the tub ring and D-ring splash shields taken along line V—V of FIG. 1.

As illustrated in FIG. 5, the housing top 34 includes a D-ring splash shield 102. The D-ring splash shield 102 has one end 104 that defines a loop 106 and another end 108 that extends from the loop 106 to contact an upper surface 110 of the tub ring 16. The D-ring splash shield 102 attaches to the housing top 34 at the loop end 106. The loop end 104 is secured to a bottom surface 112 of the housing top 34. The loop end 106 can be secured with a tie strap or similar fastening device that is threaded through the loop end 106 and tightened to fasten the loop end 106 to the housing top 34. Once attached, the D-ring splash shield 102 can extend along an entire periphery or at least a portion of the periphery of the bottom surface 112 to provide a barrier between the wash tub 14 and an inner area 114 of the housing 12 so as to further direct wash additives into the wash tub and to also prevent wash fluid spray from escaping from the wash tub 14 during the spin cycle. In addition, the D-ring splash shield 102 acts as a sound barrier to prevent operational noise from escaping to the surrounding environment.

As further illustrated in FIG. 5, the tub ring 16 also includes a tub ring splash shield 116. The tub ring splash shield 116 generally attaches to an outer edge 116 of the tub ring 16 and extends along at least a portion of the outer edge 118. The tub ring splash shield 116 has a rigid part 120 and a flexible part 122, but may also be formed completely from flexible material. The rigid part 120 firmly secures the tub ring splash shield 116 to the tub ring 16. The rigid part 120 can be formed of nylon or other similar rigid material. The flexible part 122 extends upwardly to provide a barrier between the wash tub 14 and an outer area 124 of the housing 12 to direct wash additives into the wash tub 14 and also prevent wash fluid spray from escaping from the wash tub 14. The flexible part 122 can be formed of PVC or similar flexible material.

The D-ring 102 and tub ring 116 splash shields act most effectively to direct wash additives into the wash tub and to prevent wash fluid spray from escaping the wash tub 14 under dynamic washing conditions. The wash basket 24 and wash tub 14 are suspended from the housing 12 such that the basket 24 and tub 14 form a suspended mass. During operation, the wash tub 14 and wash basket 24 do not remain in a stationary position relative to the housing 12. Accordingly, under dynamic conditions, the tub ring 16 may not be positioned directly beneath the dispensers as is the case during static conditions. As a result, when wash additives are released from the dispensers 36, 38, 40 under dynamic conditions, the tub ring 16 with louvered area 34 may not be positioned so as to direct the entire charge of wash additives into the wash tub 14. The D-ring 100 and tub ring 116 splash shields further act to direct the wash additives into the wash tub 14. Likewise, when the wash fluid spray escapes from the gap 126 between the wash tub 14 and wash basket 24 during dynamic conditions, the D-ring 102 and tub ring 116 splash shields additionally act to block the wash fluid spray from escaping from the wash tub 14 and inevitably from the washer 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

The embodiments of the invention in which an exclusive property or privilege is claimed are therefore defined as follows:

1. A detergent dispensing method for an automatic washer comprising the following steps:

providing an automatic vertical axis washer comprising a housing enclosing a wash tub, a wash basket, and a tub ring; said housing further comprises a housing top and a dispenser wherein said dispenser attaches to said housing top; said wash basket being rotatable about a vertical axis and disposed within said wash tub; said tub ring secured to said wash tub and defining an opening to provide an access to said wash basket; and said tub ring comprises a louvered area creating a drop zone through which wash additives are directly dispensed into said wash tub;

providing water in said wash tub;

introducing said wash additives into said dispenser;

directing said wash additives from said dispenser onto said louvered area and through said drop zone after which said wash additives are directly dispensed into said wash tub;

mixing said wash additives and said water to form a wash fluid in said wash tub; and passing said wash fluid into said wash basket to provide an effective cleaning treatment of the clothes.

2. The detergent dispensing method according to claim 1 wherein said louvered area is positioned below said dispenser.

3. The detergent dispensing method according to claim 1 wherein said louvered area comprises a plurality of vanes extending downward defining said drop zone through which wash additives flow directly into said wash tub.

4. The detergent dispensing method according to claim 3 wherein said wash basket has a rotational direction and further comprises said plurality of vanes being angled in said rotational direction so as to prevent wash fluid from escaping from said automatic vertical axis washer.

5. The detergent dispensing method according to claim 1 wherein said louvered area extends along at least a portion of a periphery of said tub ring.

6. The detergent dispensing method according to claim 1 wherein said dispenser comprises a plurality of dispensers in which wash additives are dispensed into said automatic vertical axis washer.

7. The detergent dispensing method according to claim 1 wherein said tub ring has an outer edge and further comprises a tub ring splash shield attached along said outer edge and extending upward to provide a barrier so as to direct said wash additives into said wash tub and to further prevent wash fluid from escaping from said wash tub.

8. The detergent dispensing method according to claim 7 wherein said tub ring splash shield further comprises a rigid part attaching to said tub ring and a flexible part extending upward from said rigid part.

9. The detergent dispensing method according to claim 1 wherein said housing top has a bottom surface and further comprises a D-ring splash shield attached along at least a portion of said bottom surface and extending downward to create a barrier so as to direct wash additives into said wash tub and to further prevent wash fluid from escaping from said wash tub.

10. An apparatus for dispensing detergent in an automatic vertical axis washer comprising:

a housing enclosing a wash tub, a wash basket, and a tub ring;

said housing further comprising a housing top and a dispenser wherein said dispenser is attached to said housing top;

said wash basket being rotatable about a vertical axis and disposed within said wash tub;

said tub ring secured to said wash tub and defining an opening to provide an access to said wash basket; and said tub ring comprising a louvered area creating a drop zone through which wash additives are directly dispensed into said wash tub.

11. An apparatus for dispensing detergent according to claim 10 wherein said louvered area is positioned below said dispenser.

12. An apparatus for dispensing detergent according to claim 10 wherein said louvered area comprises a plurality of vanes extending downward defining said drop zone through which wash additives flow directly into said wash tub.

13. An apparatus for dispensing detergent according to claim 12 wherein said wash basket has a rotational direction and further comprises said plurality of vanes being angled in said rotational direction so as to prevent wash fluid from escaping from said automatic vertical axis washer.

14. An apparatus for dispensing detergent according to claim 10 wherein said louvered area extends along at least a portion of a periphery of said tub ring.

15. An apparatus for dispensing detergent according to claim 10 wherein said dispenser comprises a plurality of dispensers in which wash additives are dispensed into said automatic vertical axis washer.

16. An apparatus for dispensing detergent according to claim 10 wherein said tub ring has an outer edge and further comprises a tub ring splash shield attached along at least a portion of said outer edge and extending upward to provide a barrier so as to direct said wash additives into said wash tub and to further prevent wash fluid from escaping from said wash tub.

17. An apparatus for dispensing detergent according to claim 10 wherein said tub ring splash shield further comprises a rigid part attaching to said tub ring and flexible part extending upward from said rigid part.

18. An apparatus for dispensing detergent according to claim 10 wherein said housing top has a bottom surface area further comprises a D-ring splash shield attached along said bottom surface and extending upward to create a barrier so as to direct said wash additives into said wash tub and to further prevent wash fluid from escaping from said wash tub.

19. A system for dispensing wash additives in a vertical axis washer comprising:

an imperforate vertical axis wash tub having an open top;

a perforate wash basket having an open top rotatably mounted within said wash tub;

a housing surrounding said wash tub, said housing having a top panel with an openable lid thereon;

a tub ring mounted on said open top of said tub and extending radially inwardly to a central opening smaller than said open top of said basket;

said tub ring having an outer edge and being positioned below said top panel of said housing;

a plurality of dispensers located on said top panel below said lid, said dispenser arranged to receive a charge of wash additive and having a selectively openable opening through which said wash additive is dropped;

said tub ring having a louvered area positioned below said opening of said dispenser such that additive will fall through said louvered area into said tub;

a tub ring splash shield attached to said outer edge of said tub ring and extending upward so as to direct said wash additive into said tub and to further prevent wash fluid from escaping from said washer; and a D-ring splash shield attached to said top panel and extending downward to create a barrier so as to direct said wash additive into said tub and to further prevent wash fluid from escaping from said washer.

* * * * *